US006049920A

United States Patent [19]

Mochizuki

[11] Patent Number: 6,049,920

[45] Date of Patent: Apr. 18, 2000

[54] SHOWER CURTAIN SPACER

[76] Inventor: Yasuhiro Mochizuki, 124-95 Aoyagi Sayama, Saitama, 350 1301, Japan

[21] Appl. No.: 09/307,586

[22] Filed: May 7, 1999

[51] Int. Cl.[7] ..... A47K 3/00

[52] U.S. Cl. ..... 4/609; 4/607; 4/605; 160/368.1; 160/DIG. 6

[58] Field of Search ..... 4/607–610, 557–559, 4/546, 576.1, 577.1; 160/368.1, DIG. 6; 211/105.3, 105.4, 180; 248/229.12, 229.14, 229.22, 229.24

[56] References Cited

U.S. PATENT DOCUMENTS

| | | | |
|---|---|---|---|
| D. 188,175 | 6/1960 | Craig | 4/576.1 |
| 1,159,507 | 11/1915 | Lang . | |
| 2,725,576 | 12/1955 | Schwersinske | 4/609 |
| 2,764,382 | 9/1956 | Gubernick . | |
| 2,931,051 | 4/1960 | Sparling | 4/577.1 |
| 2,940,085 | 6/1960 | Hussey | 4/577.1 |
| 3,282,328 | 11/1966 | Mushro, et al. . | |
| 3,808,610 | 5/1974 | Mortensen . | |
| 3,950,793 | 4/1976 | Adams | 4/559 |
| 3,968,524 | 7/1976 | Zentman | 4/577.1 |
| 4,088,174 | 5/1978 | Edwards . | |
| 5,305,477 | 4/1994 | Cochran . | |
| 5,365,619 | 11/1994 | Solomon . | |
| 5,659,904 | 8/1997 | Doczy et al. | 4/576.1 |

*Primary Examiner*—Charles R. Eloshway
*Attorney, Agent, or Firm*—Larson & Larson, P.A.; James E. Larson

[57] ABSTRACT

A shower curtain spacer attaches to the rim of a bathtub or shower stall to hold a shower curtain away from the rim. The spacer includes a clamping mechanism having a first leg portion attached to a second leg portion at a right angle from one another. An adjustable sliding portion, in parallel relation to the second leg portion moves along the first leg portion to secure the device to the bathtub or shower stall rim. A screw locks the adjustable sliding portion in place. An elongated cylindrical bar sets within the tub area and is spaced from an inner surface of the tub when the shower curtain spacer is employed. The elongated bar is removably attached to the clamping mechanism by an intermediate block member including a body portion a pair of fingers for inserting within a pair of apertures in the clamping mechanism and a concave portion for receiving and retaining the elongated bar in a rigid and fixed position.

20 Claims, 4 Drawing Sheets

SHOWER CURTAIN SPACER

BACKGROUND OF THE INVENTION

1. Field of the Invention

This invention relates to a spacer for shower curtains. More particularly, it relates to a device for mounting to the rim of bathtub of a shower stall for holding a bottom end of a shower curtain away from an inner surface of the bathtub.

2. Description of Prior Art

Mold and mildew growth are common problems associated with the use of bathtubs and showers. In high humid climates mold and mildew easily propagates. Even in dry climates, the surfaces of a bathtub and/or shower can support the growth of mold and mildew if the tub and shower are not allowed to properly dry. It is further known that mold and mildew are common allergens to many people due to being parasitic fungi.

Many homes are designed with bathrooms that have a combined bathtub and shower. Typically, the bathtub is installed within an alcove of the bathroom and a shower head is provided thereabove. In order to avoid water from splashing about the bathroom, a curtain or shower door is typically employed along an outer wall of the tub to isolate the shower user within a closed space or shower stall. Shower doors are usually made from plastic or glass, thereby making them expensive and less desirable. Further, if a family has small children, they may wish to avoid the use of glass shower doors due to the possibility of the door shattering and causing injury to the child. Therefore, many people employ a simple shower curtain made of a soft and flexible plastic material. It is noted that many people prefer a shower curtain due to the fact that it is easier to maintain than a glass or plastic shower door and can be decorated in a fashion such as to add a theme to the bathroom.

The shower curtain is typically affixed at a top end by a series of clamps or rings which insert over a shower curtain rod. The curtain hangs downwardly, providing a partition between the shower stall and the rest of the bathroom area. It is common, and recommended, that the shower user tuck the bottom end of the shower curtain inside the tub, thereby avoiding any splashing of water from out of the shower stall.

Due to the fact that the bottom end of the curtain hangs within the tub area, it is common for such bottom end to come in contact with the inner surface of the tub. Further, when water is introduced, the curtain tends to stick to the inner surface of the tub. If the curtain is not completely dried after each use, mold and mildew growth is promoted between the curtain and tub inner surface. Further, due to the effects of gravity, the bottom end of the shower curtain is always the last area of the curtain to dry. Realistically, the shower curtain, and especially the bottom end, is never completely dried after each use of the shower. In fact, it is usually completely saturated.

It can therefore be appreciated that a device is needed which prohibits the shower curtain bottom end from sticking to the inner surface of the bathtub. Such a device would then discourage mold and mildew growth by permitting the bottom end of the shower curtain to properly dry. The device would need to hold the bottom end of the shower curtain away from the inner surface of the shower tub. Applicant is not aware of any prior art device which is capable of performing such a task.

SUMMARY OF THE INVENTION

Applicant has invented a novel device which discourages mold and mildew growth between the bottom end of a shower curtain and the inner surface of a shower tub. The device holds the shower curtain away from the tub in order to permit the curtain to properly dry.

This shower curtain spacer includes three main components: an L-shaped member, an adjustable sliding portion and an elongated bar member. The adjustable sliding member has a hole formed near a top end for receiving the long legged portion of the L-shaped member. The short legged portion of the L-shaped member and the adjustable sliding member form a clamping means for securing the shower curtain spacer to the rim of the tub. A securement means is provided at a top portion of the adjustable sliding member for securing it in a fixed position to the L-shaped member. The elongated bar member has a body portion for attaching to the L-shaped member, proximal to the right angle of the L-shaped member. The body portion supports the elongated bar.

When the shower curtain spacer is employed, it is rigidly affixed to the tub with the elongated bar member spaced from the inner surface of the tub in parallel relation. An angled portion at one end of the elongated bar member provides a means to space the curtain end from the inner surface of the tub end. With a pair of devices employed, such that the two angled portions are at opposite ends, the curtain is spaced from all inner surfaces of the tub. And accordingly, mold and mildew growth is discouraged.

BRIEF DESCRIPTION OF THE DRAWINGS

The invention may be best understood by those having ordinary skill in the art by reference to the following detailed description when considered in conjunction with the accompanying drawings in which.

DETAILED DESCRIPTION OF THE INVENTION

Figure 1:
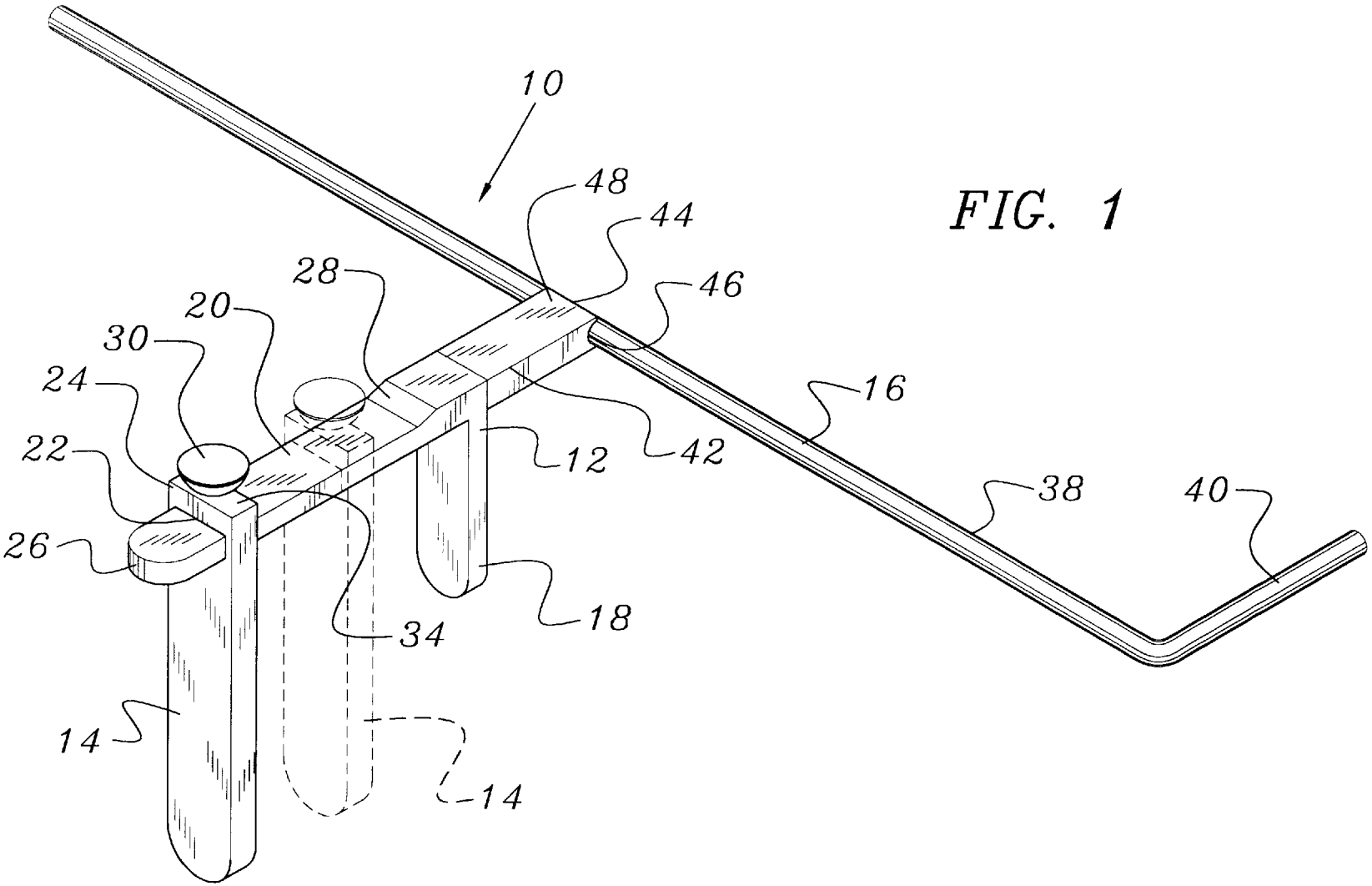
FIG. 1 is a perspective view of a SHOWER CURTAIN SPACER device of the present invention, the broken lines illustrating how an adjustable sliding portion of the device can be located in different positions.

Throughout the following detailed description, the same reference numerals refer to the same elements in all figures.

Figure 2:
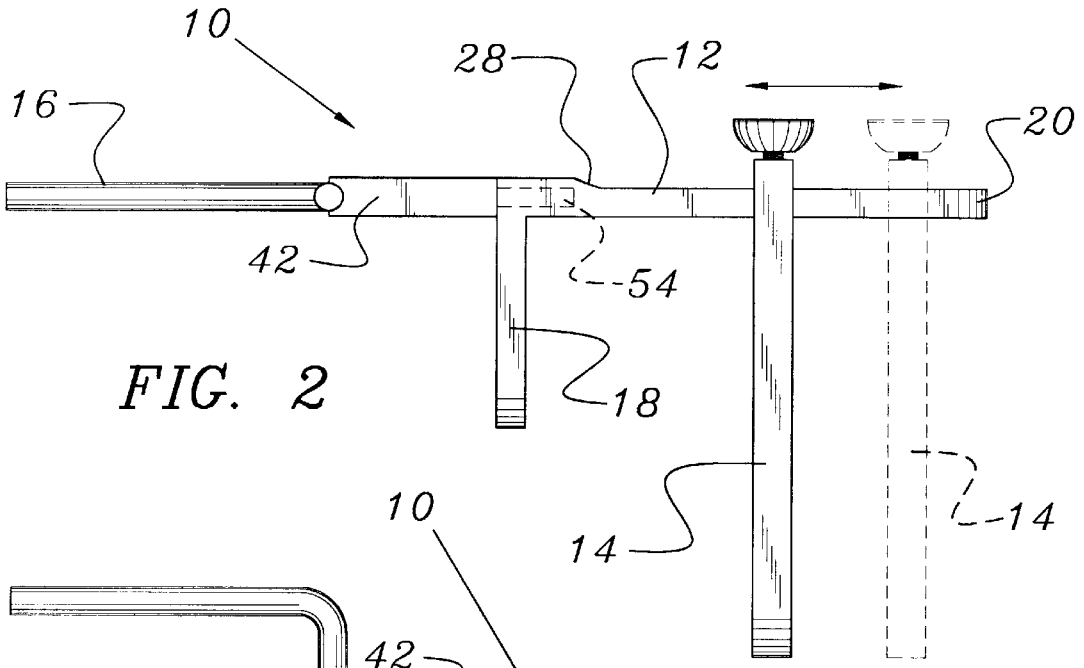
FIG. 2 is a right side elevational view of the novel device.

Referring to FIG. 1, a novel shower curtain spacer device 10 of the present invention is shown. Shower curtain spacer 10 includes an L-shaped member 12, an adjustable sliding portion 14 and an elongated bar member 16. As shown in FIG. 2, L-shaped member 12 has a short and long leg, 18 and 20 respectively, which are integrally attached and positioned at a 90 degree or right angle from one another. When shower curtain spacer 10 is positioned in an upright position, as depicted in FIG. 2, short leg 18 is vertically positioned in relation to a ground surface (not shown) whereas long leg 20 is horizontally positioned to the same ground surface.

Figure 5:
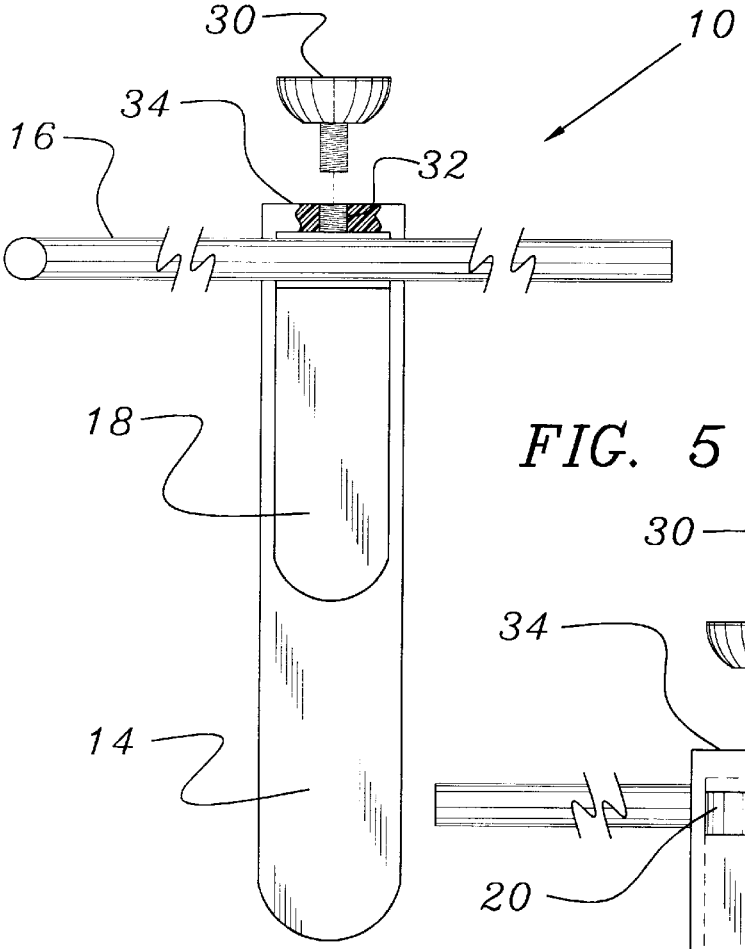
FIG. 5 is a front view of the device of the present invention.
Figure 6:
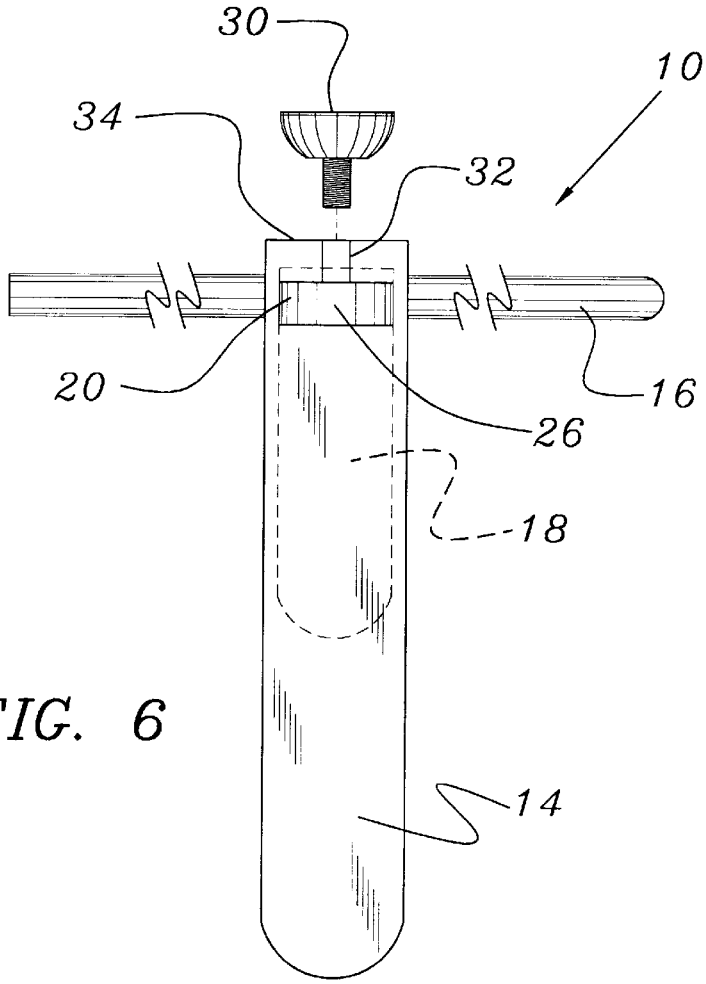
FIG. 6 is a back view of the device of the present invention.

Referring again to FIG. 1, adjustable sliding portion 14 has a generally rectangular-shaped aperture 22 formed proximal to a top end 24. Aperture 22 axially receives long leg 20 of L-shaped member 12 at a first end 26 of long leg 20 thereby permitting adjustable sliding portion 14 to move therealong. An upwardly sloping ridge 28 formed on long leg 20 a point proximal to the right angle of L-shaped member 12, and distal to long leg first end 26, provides a stop for adjustable sliding portion 14. A threaded screw 30 is provided for engaging a threaded aperture 32 (see FIGS. 5 and 6) formed in a top surface 34 of adjustable sliding portion 14 thereby providing a means for locking adjustable sliding portion 14 to L-shaped member long leg 20. The exact position that adjustable sliding portion 14 is locked is dependent on the thickness of a tub wall 36, as shown in FIG. 7.

Referring back to FIG. 1, elongated bar member 16 includes an elongated bar 38, an angled portion 40 and a support body 42. In the preferred embodiment, angled portion 40 is positioned at a right angle from elongated bar 38 and is shorter in length than elongated bar 38. Elongated bar 38 is generally cylindrical in shape and is supported by support body 42 at a generally middle point 44 along elongated bar 38. Support body 42 has a concave portion 46 formed at a distal end 48 for receiving and maintaining elongated bar 38 in a rigid and fixed position. When shower curtain spacer 10 is employed, elongated bar 38 is horizontally positioned in relation to the ground surface (not shown). In the preferred embodiment, elongated bar 38 is integrally attached to support body 42 in concave portion 46. Although in alternate embodiments, elongated bar 38 could be removably attached to concave portion 46 by means of a friction fit.

Figure 3:
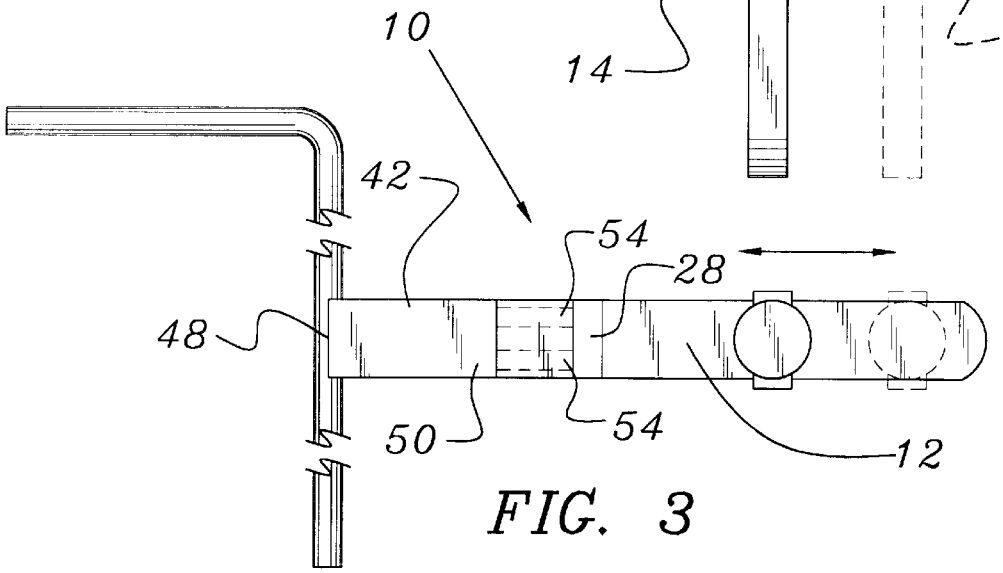
FIG. 3 is a top plan view of the device of the present invention.
Figure 4:
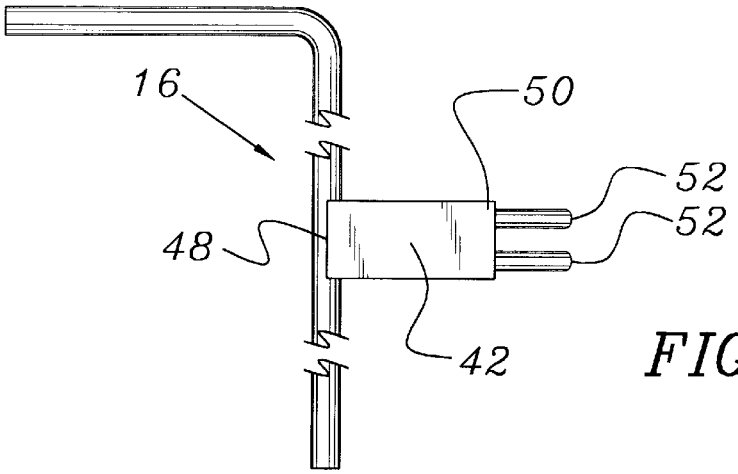
FIG. 4 is a top plan view of an elongated bar member and its associated support body of the device of the present invention.

As shown in FIGS. 3 and 4, support body 42 further includes a proximal end 50. Attached along proximal end 50 are a pair of generally cylindrical-shaped fingers 52 (see Fig. 4). As shown in FIG. 3, a pair of apertures 54 are formed in L-shaped member 12 proximal to the right angle for receiving fingers 52. In the preferred embodiment, the finger 52 to aperture 54 engagement is a friction fit permitting removal thereof, if so desired. Although in alternate embodiments, the engagement could be permanent, whereby glue could be introduced between apertures 54 and fingers 52 prior to insertion of fingers 52 therein. Further, in yet another alternate embodiment, support body 42 could be integrally attached to L-shaped member 12 whereby fingers 52 and apertures 54 are eliminated.

Figure 7:
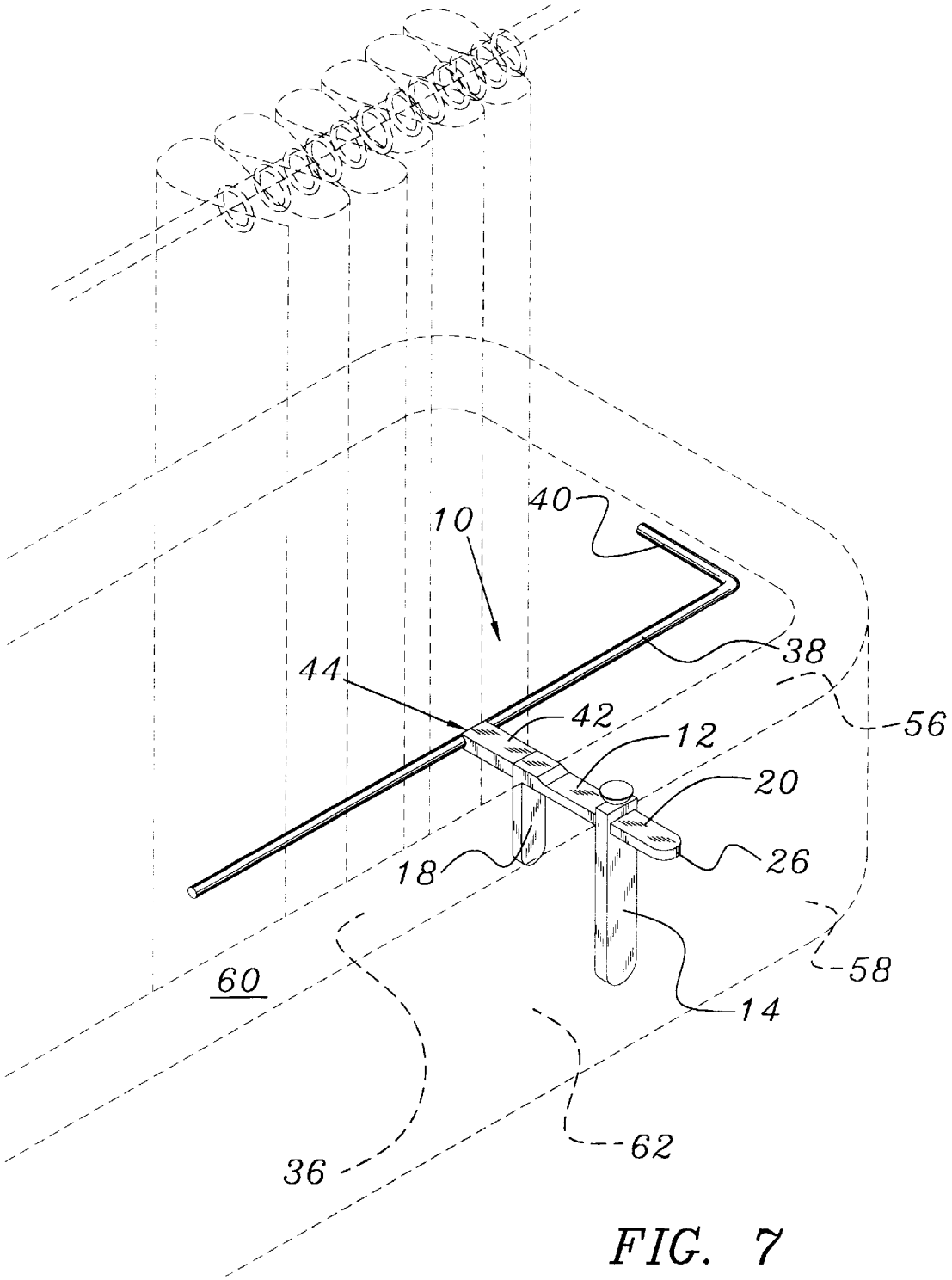
FIG. 7 is a perspective view of the device of the present invention employed on a bathtub illustrating how the device spaces a shower curtain away from the inner surfaces of the bathtub.

Referring to FIG. 7, shower curtain spacer 10 is employed by clamping onto a rim 56 of a bathtub 58. To accomplish such, L-shaped member short leg 18 is first set against an inner surface (not shown) of bathtub 58 such that L-shaped member long leg 20 rests upon a top surface 60 of bathtub 58. Adjustable sliding portion 14 is then moved towards an outer surface 62 of bathtub 58 until it sets against thereto. Screw 30 is then tightened. Shower curtain spacer 10 is ideally positioned such that elongated bar member angled portion 40 makes its turn at the same point within bathtub 58 that the inner surface of bathtub 58 makes. This ensures that the end and middle portions of a shower curtain make no contact with the inner surface of bathtub 58. Further, if two shower curtain spacers are employed, each having its respective angled portion 40 at opposed ends, the two devices can work in conjunction to ensure that no portion of the shower curtain touch any part of bathtub 58. And hence, the curtain can properly dry thereby discouraging mold and mildew growth.

Equivalent elements can be substituted for the ones set forth above herein such that they perform the same function in the same way for achieving the same result.

What is claimed is:

1. A shower curtain spacer for use in a bathtub or shower stall to hold a shower curtain inwardly away from an inner surface of the bathtub or shower stall, the bathtub or shower stall having an upwardly extending rim, the spacer comprising:

a) an L-shaped member having a first and second leg positioned at a right angle from one another, b) a substantially planar adjustable sliding portion slidably received around the L-shaped member first leg such that it is in parallel relation to the L-shaped member second leg and works in conjunction therewith to clamp the shower curtain spacer to the rim of the bathtub or shower stall, c) an elongated bar mounted to the L-shaped member, proximal to the right angle of the L-shaped member, such that the elongated bar is spaced inwardly from an inner surface of the bathtub or shower stall rim when the shower curtain spacer is employed, and d) the shower curtain resting on the elongated bar inwardly away from the inner surface of the bathtub or shower stall rim in use.

2. The shower curtain spacer according to claim 1, wherein the L-shaped member first leg has a greater length than that of the L-shaped member second leg.

3. The shower curtain spacer according to claim 1, wherein the adjustable sliding portion has a greater length than that of the L-shaped member second leg.

4. The shower curtain spacer according to claim 1, wherein the adjustable sliding portion comprises a generally rectangular-shaped elongated tongue.

5. The shower curtain spacer according to claim 4, wherein the adjustable sliding portion has a generally rectangular-shaped aperture formed near a top end of the elongated tongue for receiving the L-shaped member first leg.

6. The shower curtain spacer according to claim 5, wherein the adjustable sliding portion further comprises a means for securing the adjustable sliding portion to the L-shaped member first leg.

7. The shower curtain spacer according to claim 1, wherein the elongated bar has an angled portion at a first end and a central portion which has a greater length than that of the angled portion.

8. The shower curtain spacer according to claim 1, wherein the elongated bar is removably mounted to the L-shaped member.

9. A shower curtain spacer for use in a bathtub or shower stall to hold a shower curtain inwardly away from an inner surface of the bathtub or shower stall, the bathtub or shower stall having an upwardly extending rim, the spacer comprising:

a) an L-shaped member having a first and second leg positioned at a right angle from one another, the first leg having a greater length than that of the second leg, b) an adjustable sliding portion comprising an elongated substantially planar tongue and an aperture formed near a top end of the adjustable sliding portion, the aperture receiving the L-shaped member first leg such that the adjustable sliding portion is in parallel relation to the L-shaped member second leg and works in conjunction therewith to clamp the shower curtain spacer to the rim of the bathtub or shower stall, c) an elongated bar mounted to the L-shaped member, proximal to the right angle of the L-shaped member, such that the elongated bar is spaced inwardly from an inner surface of the bathtub or shower stall rim when the shower curtain spacer is employed, and d) the shower curtain resting on the elongated bar inwardly away from the inner surface of the bathtub or shower stall rim in use.

10. The shower curtain spacer according to claim 9, wherein the adjustable sliding portion elongated tongue has a greater length than that of the L-shaped member second leg.

11. The shower curtain spacer according to claim 10, wherein the L-shaped member second leg has at least one planar surface for setting against an inner surface of the bathtub or shower stall rim and the adjustable sliding portion elongated tongue has at least one planar surface for setting against an outer surface of the bathtub or shower stall rim when the shower curtain spacer is employed in its locked position.

12. The shower curtain spacer according to claim 11, wherein the adjustable sliding portion further comprises a threaded screw for engaging a threaded aperture formed in a top end of the adjustable sliding portion elongated tongue and for locking the adjustable sliding portion to the L-shaped member first leg.

13. The shower curtain spacer according to claim 9, wherein the elongated bar has an angled portion at a first end and a central portion which has a greater length than that of the angled portion.

14. The shower curtain spacer according to claim 9, further comprising an elongated bar mounting block.

15. The shower curtain spacer according to claim 14, wherein the elongated bar mounting block is removably attached to the L-shaped member.

16. The shower curtain spacer according to claim 15, wherein the elongated bar mounting block comprises a body portion, a pair of outwardly extending fingers and a concave portion, the pair of fingers positioned at an end opposed from that of the concave portion, the pair of fingers for inserting within a pair of apertures formed in the L-shaped member, proximal to the right angle, the concave portion for receiving and retaining the elongated bar.

17. A shower curtain spacer for use in a bathtub or shower stall to hold a shower curtain inwardly away from an inner surface of the bathtub or shower stall, the bathtub or shower stall having an upwardly extending rim, the spacer comprising:

a) an L-shaped member having a first and second leg positioned at a right angle from one another, the first leg having a greater length than that of the second leg, b) an adjustable sliding portion comprising an elongated substantially planar tongue and an aperture formed near a top end of the adjustable sliding portion, the aperture receiving the L-shaped member first leg such that the adjustable sliding portion is in parallel relation to the L-shaped member second leg and works in conjunction therewith to clamp the shower curtain spacer to the rim of the bathtub or shower stall, the elongated tongue having a greater length than that of the L-shaped member second leg, c) an elongated bar having an angled portion at a first end, the elongated bar mounted to the L-shaped member by an intermediate mounting block such that the elongated bar is inwardly spaced from an inner surface of the bathtub or shower stall rim when the shower curtain spacer is employed, and d) the shower curtain resting on the elongated bar inwardly away from the inner surface of the bathtub or shower stall rim in use.

18. The shower curtain spacer according to claim 17, wherein the L-shaped member second leg has at least one planar surface for setting against an inner surface of the bathtub or shower stall rim and the adjustable sliding portion elongated tongue has at least one planar surface for setting against an outer surface of the bathtub or shower stall rim when the shower curtain spacer is employed in its locked position.

19. The shower curtain spacer according to claim 18, wherein the adjustable sliding portion further comprises a threaded screw for engaging a threaded aperture formed in a top end of the adjustable sliding portion elongated tongue and for locking the adjustable sliding portion to the L-shaped member first leg.

20. The shower curtain spacer according to claim 17, wherein the intermediate mounting block comprises a body portion, a pair of outwardly extending fingers and a concave portion, the pair of fingers positioned at an end opposed from that of the concave portion, the pair of fingers for inserting within a pair of apertures formed in the L-shaped member, proximal to the right angle, the concave portion for receiving and retaining the elongated bar.

* * * * *